US009670735B2

(12) United States Patent
Servaes et al.

(10) Patent No.: US 9,670,735 B2
(45) Date of Patent: Jun. 6, 2017

(54) SYSTEM AND METHOD FOR ONE-TRIP HOLE ENLARGEMENT OPERATIONS

(75) Inventors: Luk Servaes, Lafayette, LA (US); Stefano Mancini, Ravenna (IT)

(73) Assignee: Halliburton Energy Services, Inc., Houston, TX (US)

( * ) Notice: Subject to any disclaimer, the term of this patent is extended or adjusted under 35 U.S.C. 154(b) by 1408 days.

(21) Appl. No.: 12/934,918

(22) PCT Filed: Mar. 27, 2009

(86) PCT No.: PCT/US2009/038486

§ 371 (c)(1),
(2), (4) Date: Sep. 27, 2010

(87) PCT Pub. No.: WO2009/123918

PCT Pub. Date: Oct. 8, 2009

(65) Prior Publication Data

US 2011/0024194 A1 Feb. 3, 2011

Related U.S. Application Data

(60) Provisional application No. 61/040,849, filed on Mar. 31, 2008.

(51) Int. Cl.
*E21B 7/28* (2006.01)
*E21B 10/32* (2006.01)

(52) U.S. Cl.
CPC ..... *E21B 7/28* (2013.01); *E21B 10/32* (2013.01)

(58) Field of Classification Search
CPC ..... E21B 7/28; E21B 10/32
USPC ..... 175/53, 263, 385, 390, 391
See application file for complete search history.

(56) References Cited

U.S. PATENT DOCUMENTS

| | | | | |
|---|---|---|---|---|
| 2,654,575 | A * | 10/1953 | Kammerer | 175/266 |
| 2,754,090 | A * | 7/1956 | Kammerer | 175/266 |
| 4,036,314 | A | 7/1977 | Dixon et al. | 175/364 |
| 4,117,895 | A | 10/1978 | Ward et al. | 175/53 |
| 4,193,464 | A | 3/1980 | Dixon | 175/364 |
| 5,074,356 | A * | 12/1991 | Neff | 166/55.7 |
| 5,341,888 | A | 8/1994 | Deschutter | 175/323 |
| 5,368,114 | A | 11/1994 | Tandberg et al. | 175/267 |
| 6,070,677 | A | 6/2000 | Johnston, Jr. | 175/57 |
| 6,474,425 | B1 * | 11/2002 | Truax et al. | 175/398 |
| 6,732,817 | B2 | 5/2004 | Dewey et al. | 175/57 |
| 7,111,694 | B2 | 9/2006 | Beaton | 175/53 |
| 2005/0133278 | A1 | 6/2005 | Azar et al. | 175/426 |
| 2005/0274546 | A1 | 12/2005 | Fanuel et al. | 175/57 |
| 2007/0007043 | A1 * | 1/2007 | Dewey et al. | 175/75 |
| 2011/0024194 | A1 | 2/2011 | Servaes et al. | 175/57 |

OTHER PUBLICATIONS

Hole Opener Coporation; "Hole Opener"; www.holeopener.com; Pgs. Sep. 27, 2010.
International Search Report and Written Opinion, Application No. PCT/US2009/038486, 8 pages, May 12, 2009.

* cited by examiner

*Primary Examiner* — Elizabeth Gitlin
(74) *Attorney, Agent, or Firm* — Baker Botts L.L.P.

(57) ABSTRACT

A drilling assembly for simultaneous hole enlargement operations comprises a drill bit, an adjustable diameter reamer, and a hole opener. The reamer is coupled with, and positioned uphole from the drill bit. The reamer is adjustable between a first diameter and a second diameter that is larger than the first diameter. The hole opener is coupled with, and positioned uphole from the reamer.

19 Claims, 5 Drawing Sheets

SYSTEM AND METHOD FOR ONE-TRIP HOLE ENLARGEMENT OPERATIONS

CROSS REFERENCE TO RELATED APPLICATIONS

This application is a U.S. National Stage Application of International Application No. PCT/US2009/038486 filed Mar. 27, 2009, which designates the United States and claims the benefit of U.S. Provisional Application Ser. No. 61/040,849, filed Mar. 31, 2008, which are hereby incorporated by reference in their entirety.

TECHNICAL FIELD

The present invention relates generally to drilling operations, and more specifically to a system and method for one-trip hole enlargement operations.

BACKGROUND

When drilling oil and gas wells, it is frequently desirable to ream a borehole that has been initially created by a drill bit or other cutting tool. This reaming can remove any projections that may have been missed by the first pass of the drilling assembly, creating a more uniform borehole. In addition, a reamer may be used to enlarge a borehole (e.g., below a casing shoe), allowing, for example, the installation of additional casing strings.

However, since optimum reamers often cannot be used until they have passed through a first cased section of the borehole, additional obstructions often remain inside the casing that prevent or hinder the installation of additional downhole casing strings. In the past, material in the first casing was removed through the use of a separate, dedicated drill-out, requiring additional time and expense. Alternatively, reamers that were less than optimally-sized for use with a corresponding drill bit were employed. These approaches may reduce the stability of the drilling assembly, which may result in more vibrations and drilling inefficiency.

SUMMARY OF EXAMPLE EMBODIMENTS

The present disclosure is directed to a system and method for one-trip hole enlargement operations. The teachings of the present disclosure allow more efficient operation of drilling assemblies.

In accordance with a particular embodiment of the present disclosure, a system for simultaneous hole enlargement operations includes a drilling assembly comprising a drill bit. The drilling assembly further comprises an adjustable diameter reamer that is coupled with the drill bit and positioned uphole from the drill bit. The reamer is adjustable between a first diameter and a second diameter that is greater than the first diameter. The drilling assembly further comprises a hole opener that is coupled with and positioned uphole from the reamer. More specifically, the present invention may also includes a stabilizer positioned uphole from the hole opener.

In accordance with another aspect of the present invention, a method is provided, comprising drilling a borehole through material in a casing, using a drill bit. The method further comprises actuating an adjustable diameter reamer from a first position, having a first diameter, to a second position, having a second diameter that is larger than the first diameter. The reamer is coupled with and positioned uphole from the drill bit. The method further comprises enlarging a portion of the borehole adjacent to the bottom of the casing using a hole opener, wherein the hole opener is coupled with and positioned uphole from the reamer. More specifically, the present invention may also comprise passing the reamer, in the first position, through the casing. The invention may further comprise actuating the reamer to the second position after it has passed through the casing, and then enlarging the borehole downhole from the casing using the reamer.

Technical advantages of particular embodiments of the present disclosure include the ability to run the desired bottom hole assembly (BHA) tools and enlarge the borehole in a single pass, without the use of multiple drill strings. Additionally, the drill bit and BHA tools may be re-used for additional passes, while the reamer and/or hole opener may be altered or even removed. Thus, both time and money are saved.

Further technical advantages of particular embodiments of the present disclosure include a downhole tool configuration, in which only two cutting structures are engaged in cutting activities at the same time, instead of three. More specifically, after the reamer is activated, only the drill bit and reamer may be engaged in cutting activities. Therefore, the amount of vibrations and resulting drill string inefficiencies are reduced. Additional technical advantages of particular embodiments of the present disclosure include the use of drill bit that is appropriately sized for the corresponding reamer, allowing for utilization of stabilization features of the reamer. This may improve the overall stability of the drilling assembly, reduce vibration, improve drilling efficiency, improve logging quality, improve the accuracy of other BHA tools located along the drill string, and improve cost efficiency.

Other technical advantages of the present disclosure will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and for further features and advantages thereof, reference is now made to the following description taken in conjunction with the accompanying drawings, in which.

DETAILED DESCRIPTION

When drilling oil and gas wells, it is frequently desirable to use a reamer in conjunction with a drill bit, providing simultaneous hole enlargement. The reamer can enlarge the borehole, create a smoother, higher-quality borehole, and extend the life of the other drill string components. However, when used with a standard drill bit size associated with the given type of reamer, excess material, including cement and float collar equipment, is or may be left behind in the casing of the borehole. This material needs to be removed to allow for the running of subsequent casing strings. Therefore, a hole opener may be utilized to remove the excess material left behind in the first cased section of the borehole.

In accordance with the teaching of the present disclosure, a drilling assembly for simultaneous hole enlargement operations is disclosed. The object of this disclosure is to allow for the improved utilization of bottom hole assembly (BHA) elements in simultaneous hole enlargement operations.

According to one embodiment of the present disclosure, a drill bit is provided for drilling a borehole through a formation. An adjustable diameter reamer is coupled to the drill bit and positioned uphole from the drill bit. The reamer is adjustable between a first position having a first diameter and a second position having a second diameter that is larger than the first diameter. In operation, the reamer maintains the first position until it has passed through a cased portion of the borehole. After passing through, the reamer is then actuated to the second position, allowing it to enlarge portions of the borehole downhole from the casing. Additionally, a hole opener is coupled to the reamer and positioned uphole from the reamer. The hole opener is used to enlarge the borehole inside a cased portion of the borehole. According to another embodiment, one or more stabilizers may also be included in the drilling assembly. The one or more stabilizer is coupled to and positioned uphole from the hole opener.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of particular ways to make and use the invention, and do not delimit the scope of the present invention.

Figure 1:
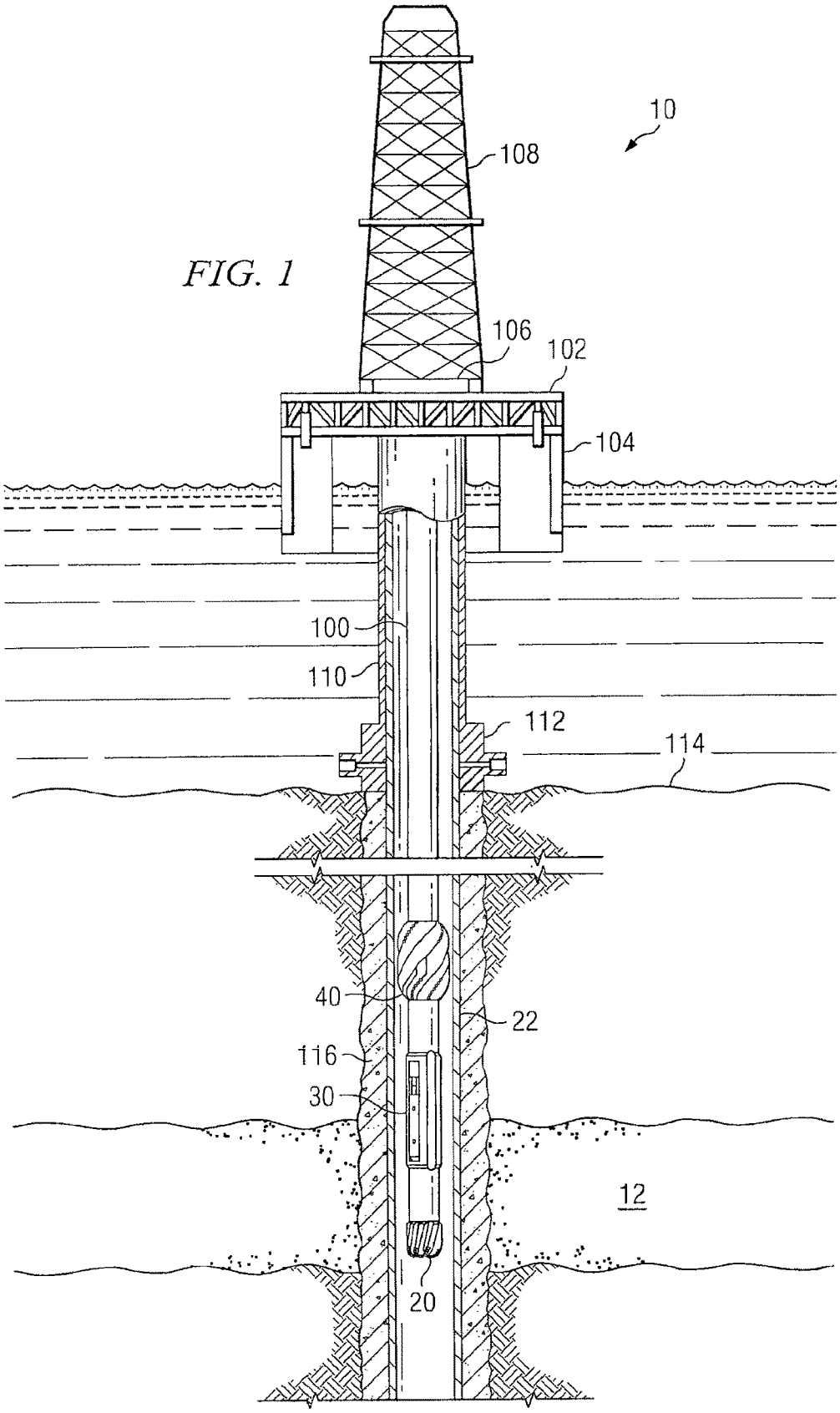
FIG. 1 is a schematic illustration of an oil and gas drilling rig, including the drilling assembly in accordance with the present invention.

FIG. 1 is a schematic illustration of an oil and gas production operation 10, including a drilling assembly in accordance with the present invention. A semi-submersible platform 102 is located over a submerged oil and gas formation 12 located below a sea floor 114. A subsea conduit 110 extends from a deck 104 of the platform 102 to a wellhead installation 112. Platform 102 has a hoisting apparatus 106 and a derrick 108 for raising and lowering pipe strings such as the work string 100.

A wellbore 116 extends through various earth strata, including formation 12. A casing 22 is cemented within wellbore 116 by cement. Work string 100 comprises a drill bit 20, an adjustable diameter reamer 30, and a hole opener 40. Each of these components is discussed in more detail below. Additionally, work string 100 may or may not include additional BHA elements. These elements may include, but are not limited to stabilizers, cross-over subs for connecting BHA elements, logging while drilling (LWD) components, measuring while drilling (MWD) components, or rotary steerable system (RSS) components. These BHA elements may be placed at various positions along the work string without affecting the hole enlargement operations of the present disclosure.

Although FIG. 1 depicts a vertical well, the drilling assembly of the present invention is equally well-suited for use in wells having other directional orientations, such as deviated wells, inclined wells, or horizontal wells. Accordingly, the terms "downhole" and "uphole" are defined herein to describe locations away from and toward, respectively, the wellhead installation 112. In other words, one object which is downhole from another is farther away from wellhead installation 112 than the other object, and one object which is uphole from another is closer to the wellhead installation 112 than the other object. Also, even though FIG. 1 depicts an offshore operation, the drilling assembly of the present invention is equally well-suited for use in onshore operations. Also, even though FIG. 1 depicts one formation and one production interval, the drilling assembly of the present invention is equally well-suited for use with any number of formations and production intervals.

FIGS. 2A-2E are sequential views illustrating both a drilling assembly and a method of use in accordance with one embodiment of the present invention.

Figure 2A:
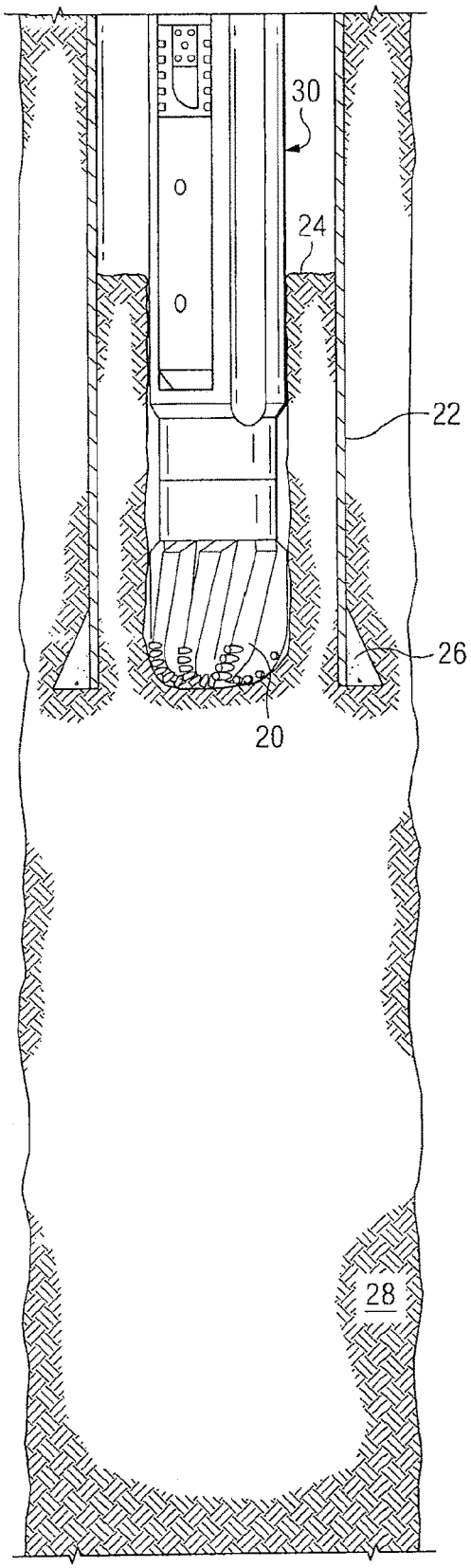
FIG. 2A is a partial view of the drilling assembly in accordance with the present invention.

FIG. 2A is a first view of a portion of the drilling assembly in accordance with the present invention, specifically drill bit 20 and reamer 30. An adjustable diameter reamer 30 is coupled to and positioned uphole from the drill bit 20. Reamer 30 is adjustable between a first position having a first diameter and a second position having a second diameter that is larger than the first diameter.

Drill bit 20 is used to drill a borehole through an earthen formation 28. In the particular embodiment shown, drill bit 20 drills a borehole through material in a casing 22. In other particular embodiments, a pilot hole may already be drilled through casing 22, and drill 20 will only drill through the formation below the casing. Drill bit 20 also has a drilling diameter which corresponds to the diameter of the borehole created by the drill bit. This drilling diameter will vary depending on the application. Factors to consider in choosing the appropriate drilling diameter include, but are not limited to the size of the reamer 30, size of casing 22, or the size of various other BHA elements included on the drilling assembly. Choosing an appropriate drilling diameter can have an important impact on performance of the drilling assembly. For instance, an appropriately-sized drilling diameter may reduce BHA "whirl" and minimize side forces and bending moments exerted on the drilling assembly. Additionally, excess vibrations may be minimized.

As shown in FIG. 2A, expandable reamer 30 maintains the first position while passing through casing 22. Similar to drill bit 20, reamer 30 can be almost any reamer, depending on the application and results desired. Factors to consider in choosing the appropriate reamer include but are not limited to the size of drill bit 20, size of casing 22, desired hole enlargement, and reamer cutting performance. According to an embodiment of the present invention, the drilling diameter of drill bit 20 is equal to or larger than the first diameter of reamer 30, allowing reamer 30 to pass through the borehole drilled by drill bit 20. Additionally, the drilling diameter of drill bit 20 may be sized such that excess material 24 remains inside the cased portion 22 of the borehole. For instance, when a 16" casing is initially run, an oil and gas developer may choose to run a 12¼" drill bit and a reamer with a first diameter that is equal to or slightly smaller than 12¼". Therefore, the drill bit would drill a borehole having a diameter of 12¼", and leaving excess material in the 16" casing. This excess material may include cement or float collar equipment that is left behind from the installation of casing 22.

Figure 2B:
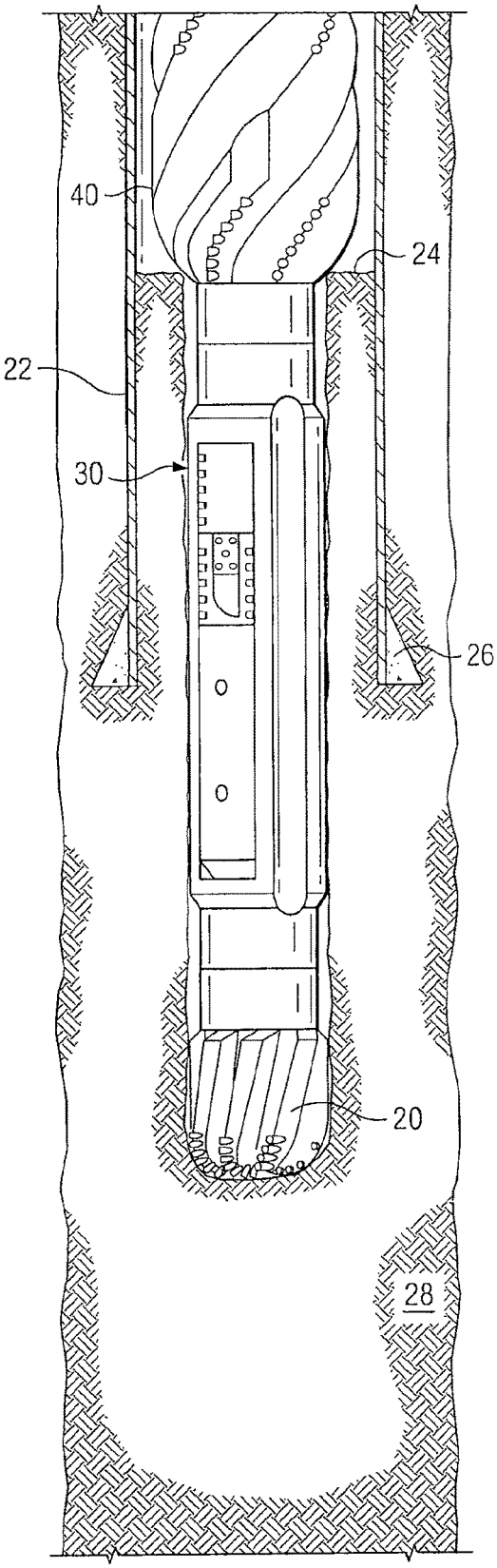
FIG. 2B is a partial view of the drilling assembly in accordance with the present invention.

FIG. 2B is a second view of the drilling assembly in accordance with the present invention. In particular, drill bit 20 continues to drill the borehole downhole from casing shoe 26 and into formation 28. Reamer 30 remains in its first position as it passes through casing 22 of the borehole. Additionally, hole opener 40, coupled to and positioned uphole from reamer 30, is introduced into contact with formation 28.

Similar to drill bit 20 and reamer 30, hole opener 40 will be chosen based on the application and desired results. Factors to consider in choosing the appropriate hole opener include, but are not limited to the size of drill bit 20, the size of reamer 30, the size of casing 22, desired hole enlargement, and hole opener cutting performance. In one particular embodiment, hole opener is chosen from a group of hole openers that have fixed blades, as opposed to adjustable cutting elements found on reamer 30. Additionally, the cutting elements of hole opener 40 may comprise polycrystalline diamond compacts (PDC). The selection of a PDC hole opener may provide for improved strength, performance, and durability. Many other types of hole openers may be used, including but not limited to those using roller cones or having adjustable blades. In particular embodiments, a second reamer may be used in place of hole opener 40. Alternatively, the functions of reamer 30 and hole opener 40 may be integrated into a single drill string element operable to provide the same cutting performance as the reamer-hole opener combination.

Figure 2C:
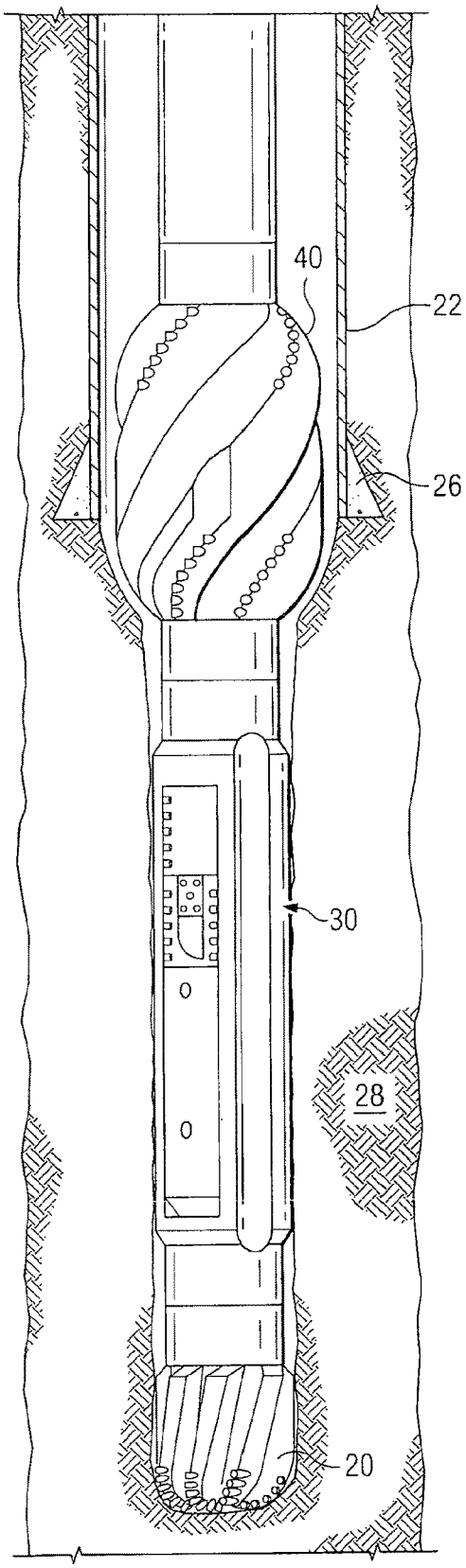
FIG. 2C is a partial view of the drilling assembly in accordance with the present invention.

In one embodiment, hole opener 40 has a diameter that is larger than the first diameter of reamer 30. This allows hole opener 40 to remove additional material 24 from the cased portion 22 of the borehole, as shown in FIG. 2C. However, as mentioned above, the size of casing 22 must also be taken into consideration. Hole opener 40 should remove excess material 24 from within casing 22, but the hole opener should be designed so that it does not contact or damage the actual casing.

Other considerations in selecting a hole opener include the presence of connections that are compatible with other drilling assembly elements. The presence of connections that are compatible with elements that are both uphole and downhole from hole opener 40 will reduce the need for extra cross-over sub elements. The elimination of these elements may reduce vibrations in the drilling assembly and improve overall life and performance of the drilling assembly. In one particular embodiment, hole opener 40 is positioned immediately uphole from reamer 30, with no additional BHA elements positioned on the drill string between them. This may be accomplished using traditional cross-over sub elements. Alternatively, if hole opener 40 has appropriate connections, it may be attached directly to reamer 30. In one embodiment, this reamer-hole opener combination is positioned between 90 and 200 feet uphole from drill bit 20. More particularly, the combination may be positioned between 154 and 200 feet uphole from the drill bit 20. However, these numbers are indicative of a particular embodiment, and may vary greatly depending on the actual application. The spacing of these elements may be chosen to allow for the inclusion of additional BHA elements between drill bit 20 and reamer 30. Additionally, the spacing may be selected to provide desired performance and vibration characteristics.

Figure 2D:
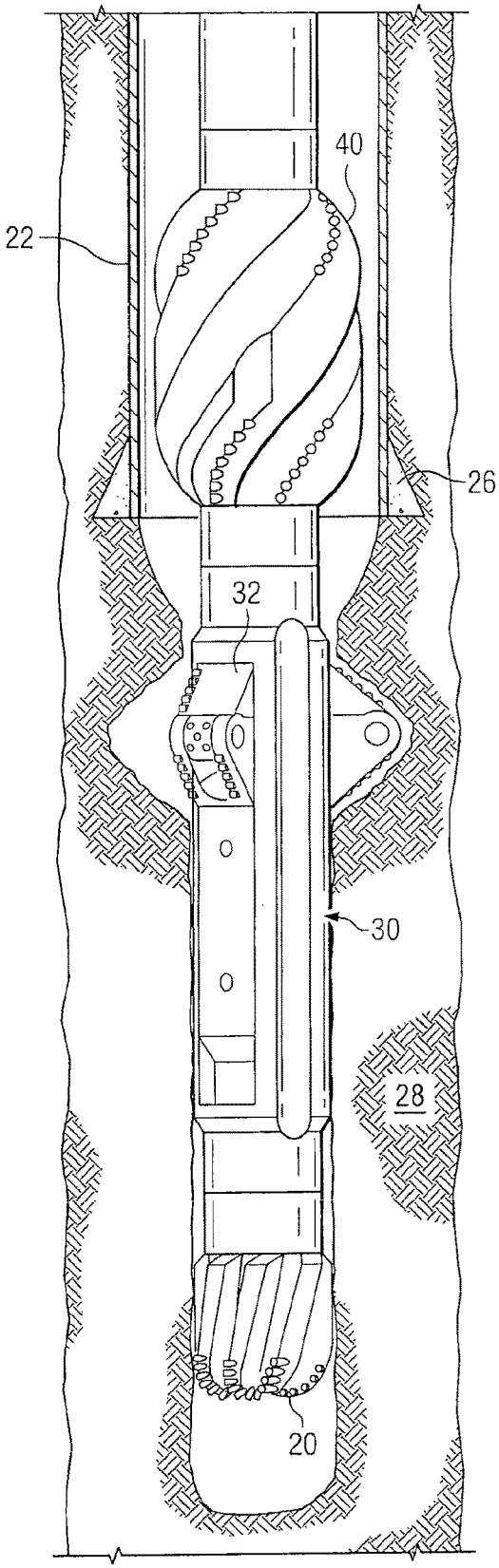
FIG. 2D is a partial view of the drilling assembly in accordance with the present invention.

In FIG. 2D reamer 30 has passed downhole from the casing shoe 26, and hole opener 40 has removed additional material 24 from casing 22 of the borehole. At this point, reamer 30 is actuated to its second position, extending cutting elements 32. Cutting elements 32 of reamer 30 are used to enlarge the borehole drilled by the drill bit 20 to a diameter that is larger than the diameter of hole opener 40.

Figure 2E:
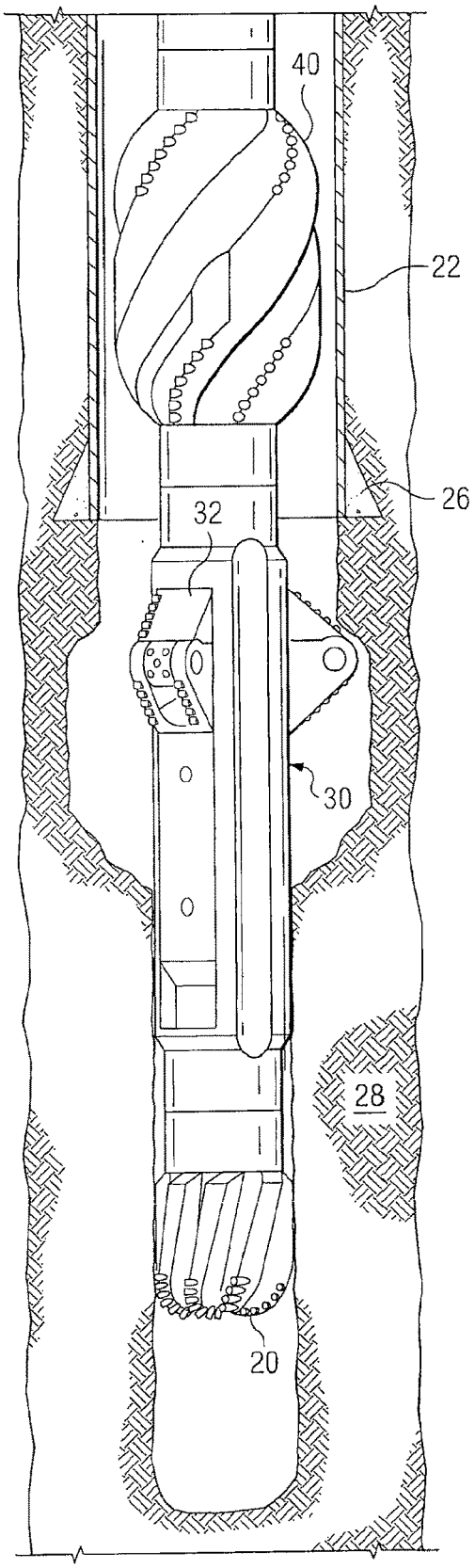
FIG. 2E is a partial view of the drilling assembly in accordance with the present invention.

As mentioned previously, reamer 30 can be almost any reamer, depending on the application and results desired. Factors to consider in choosing the appropriate reamer include but are not limited to the size of drill bit 20, size of casing 22, desired hole enlargement, and reamer cutting performance. Reamer 30 may be selected from various commercially-available adjustable-diameter reamers, including the HALLIBURTON XR™ line of reamers. According to one embodiment of the current invention, the second diameter of reamer 30 is larger than the diameter of hole opener 40. Thus, once reamer 30 begins hole enlarging operations, as shown in FIG. 2E, hole opener 40 effectively becomes "invisible" to the borehole. This means that the cutting elements of hole opener 40 no longer touch the walls of the borehole, and drill bit 20 and reamer 30 are left to perform simultaneous drilling and hole enlargement, respectively.

For instance, in one particular embodiment, the HALLIBURTON XR1200™ reamer may be used. This particular reamer is capable, with its first diameter, of passing through a 12¼" borehole. When extended to its second diameter, this particular reamer is capable of enlarging the 12¼" borehole to a 17½" diameter. Thus, the reamer is too large to operate in its second position within an original 16" casing, but is necessary to enlarge downhole portions of the borehole to prepare for running additional casing strings.

Figure 3:
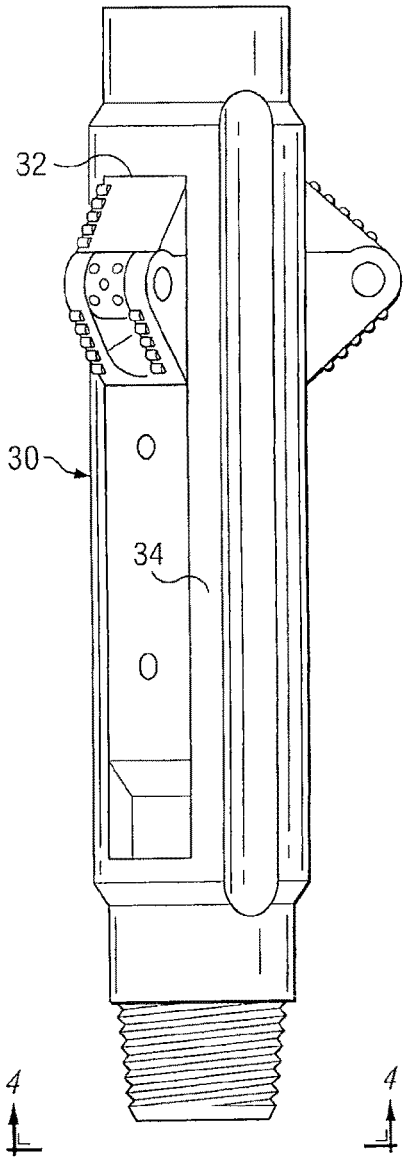
FIG. 3 is a schematic view of the reamer in accordance with the present invention.

FIG. 3 is a more detailed schematic view of the reamer in accordance with the present invention. As mentioned above, reamer 30 includes a plurality of movable cutting members 32. Cutting members 32 have a first, contracted position. This contracted position corresponds to the first diameter of reamer 30. In this first position, cutting members 32 do not protrude from reamer 30, and therefore reamer 30 does not provide any hole enlarging operations. Reamer 30, and in particular cutting members 32, are actuatable to a second, extended position. This extended position of cutting members 32 corresponds to the second diameter of reamer 30, and is illustrated by FIG. 3. In this second position, reamer 30 is operable provide hole-enlarging operations.

The second diameter of reamer 30 may be significantly larger than the drilling diameter of drill bit 20. In accordance with one embodiment of the present invention, this second diameter of reamer 30 is approximately 50 percent larger than the drilling diameter of drill bit 20. Thus, reamer 30 is capable, in certain embodiments, of enlarging a borehole by approximately 50 percent.

The cutting elements of reamer 30 may be actuatable to a second position using various different techniques. In particular embodiments, this actuation may result from a fluid differential pressure or an activation drop ball. In alternative embodiments, electronic or hydraulic means may be used to actuate reamer 30. In another embodiment, reamer 30 may also be actuated from the second position with extended cutting elements back to the first position with contracted cutting members. This may also be accomplished using varying techniques, including but not limited to a fluid differential pressure across the reamer or a de-activation drop ball.

The cutting elements of reamer 30 may be selected from a wide range of cutting elements. Factors considered in selecting the appropriate cutting elements include the desired performance of the reamer and formation material that the reamer will be operating in. The material for the cutting elements may include, but is not limited to polycrystalline diamond compacts, tungsten carbide, or boron nitride.

Additionally, reamer 30 includes self-stabilizing features that include, but are not limited to self-stabilizing element 34. When reamer 30 is used in conjunction with an appropriately-sized drill bit 20, this self-stabilizing feature serves to provide additional stability to the drilling assembly. This added stability is desirable, as it will reduce side forces and bending moments and limit lateral movements or deflections of the drilling assembly. This in turn will result in increased quality of performance by the drilling assembly, as well as increased drill string life.

With multiple elements located along the drilling assembly, care must be taken to minimize problems in the event that one or more drilling assembly elements fails. One particular type of problem in this area occurs when drill bit 20 is not in contact with the bottom of the borehole. If either reamer 30 or hole opener 40 should "stall" while drill bit 20 is in this position, this could adversely affect any BHA elements located between reamer 30 and drill bit 20 on the drilling assembly. In particular, it is important to prevent these elements from screwing off from the resulting torque of a stall. Care should be taken in selecting a maximum rotary speed for the drilling assembly, which may ensure that this does not occur. In one particular embodiment of the present disclosure, a maximum rotary speed of 100 RPM can safely be applied without accidental BHA spin-off. This value may vary depending on certain elements, including but not limited to the inclination of the wellbore and the size and number of drilling elements.

Figure 4:
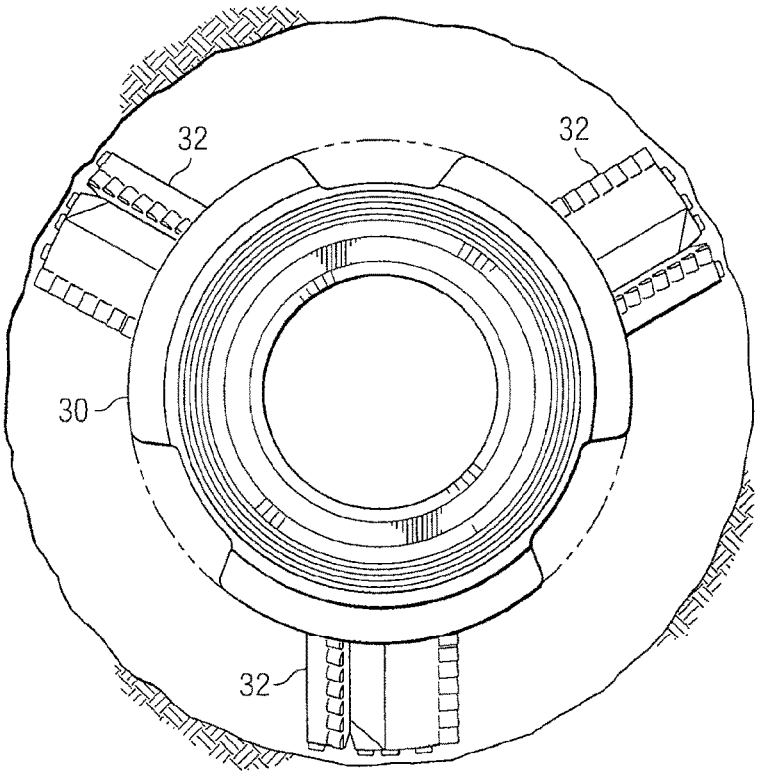
FIG. 4 is a cross-sectional view of the drill bit and reamer in accordance with the present invention.

FIG. 4 is a cross-sectional view of the drill bit 20 and reamer 30 in accordance with the present invention. In particular, this shows the size of the borehole drilled by drill bit 20. Cutting members 32 of reamer 30 can be seen in their extended position, providing the second diameter of reamer 30. Thus, reamer 30 is operable to extend the borehole to an enlarged diameter.

Figure 5:
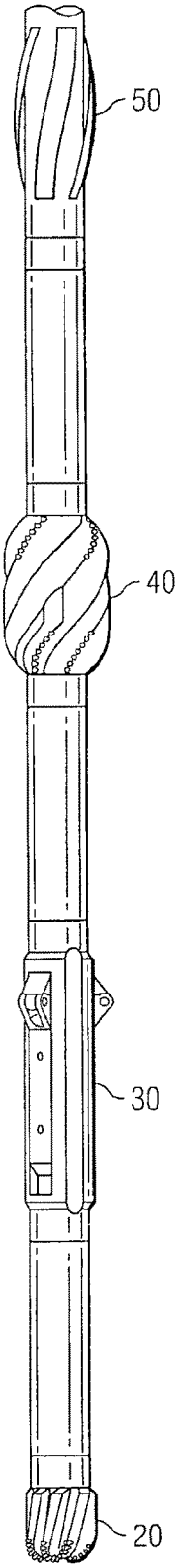
FIG. 5 is an illustration of a drilling assembly in accordance with an alternative embodiment of the present invention.

FIG. 5 is an illustration of a drilling assembly in accordance with an alternative embodiment of the present invention. In particular, this embodiment of the drilling assembly includes drill bit 20, reamer 30, hole opener 40, and stabilizer 50. Stabilizer 50 is coupled with and positioned uphole from hole opener 40. Stabilizer 50 is used to provide extra stabilization to the drilling assembly, in addition to that provided by self-stabilization feature 34 of reamer 30. In the illustrated embodiment, a single stabilizer is pictured. However, in alternative embodiments, multiple stabilizers may be employed, or the stabilizer may be omitted altogether. The inclusion and placement of one or more stabilizers will depend on the specific application.

As with other elements of the drilling assembly, specific characteristics of stabilizer 50 may be selected from a wide range of stabilizers to fit a given application. Factors to consider in choosing an appropriate stabilizer 50 include hole opener size, reamer size, and the relative position of elements along the drilling string. In one particular embodiment, stabilizer 50 is positioned approximately 30 feet uphole from hole opener 40 to provide optimum stabilization. In other embodiments, this spacing may vary.

In addition to stabilization benefits, stabilizer 50 may provide other benefits. In one particular embodiment, the stabilizer will provide a "caliper" surface indication that casing 22 has been successfully cleaned out by hole opener 40. This allows operators at the surface to know that it is safe to run in additional drilling strings, without any interference from excess material 24 remaining in casing 22. Additionally, operators may wish to actuate reamer 30 back to its first position. In this situation, stabilizer 50 may still provide this caliper functionality.

Although the present invention has been described in detail, it should be understood that various changes, substitutions, and alterations can be made without departing from the spirit and the scope of the invention as defined by the appended claims.

What is claimed is:

1. A drilling assembly, comprising:

a drill bit including a drilling diameter;

an adjustable diameter reamer being coupled with, and positioned uphole from the drill bit, the reamer being adjustable between a first diameter and a second diameter that is greater than the first diameter; and a hole opener being coupled with, and positioned uphole from the reamer;

the hole opener including one or more fixed blades and having a cutting diameter greater than the first diameter of the reamer and the drilling diameter of the drill bit, and less than the second diameter of the reamer.

2. The drilling assembly of claim 1, wherein the drilling diameter of the drill bit is equal to or larger than the first diameter of the reamer.

3. The drilling assembly of claim 1, wherein the drilling diameter of the drill bit is smaller than the second diameter of the reamer.

4. The drilling assembly of claim 1, wherein the second diameter of the reamer is approximately 50 percent larger than the drilling diameter.

5. The drilling assembly of claim 1, wherein the reamer comprises a plurality of movable cutting members, the members being actuatable from a first position, corresponding to the first diameter of the reamer, to a second position, corresponding to the second diameter of the reamer.

6. The drilling assembly of claim 5, wherein the reamer is configured to allow for actuation of the movable cutting members in response to a differential pressure.

7. The drilling assembly of claim 1, wherein the hole opener comprises a fixed blade hole opener including polycrystalline diamond compact (PDC) cutting elements.

8. The drilling assembly of claim 1, wherein the hole opener and the reamer are positioned consecutively along a drilling string.

9. The drilling assembly of claim 1, further comprising at least one bottom hole assembly element positioned between the drill bit and the reamer.

10. The drilling assembly of claim 1, further comprising at least one bottom hole assembly element positioned between the reamer and the hole opener.

11. The drilling assembly of claim 1, further comprising a stabilizer positioned uphole from the hole opener.

12. A method, comprising:

drilling a borehole through material in a casing, using a drill bit including a drilling diameter;

actuating an adjustable diameter reamer that is coupled with and positioned uphole from the drill bit from a first position having a first diameter to a second position having a second diameter that is larger than the first diameter; and enlarging a portion of the borehole adjacent to the bottom of the casing using a fixed blade hole opener with a diameter greater than the first diameter of the reamer and the drilling diameter of the drill bit, and less than the second diameter, wherein the hole opener is coupled with, and positioned uphole from the reamer.

13. The method of claim 12, further comprising:

passing the reamer, in the first position, through the casing;

actuating the reamer to the second position after the reamer has passed through the casing; and enlarging the borehole downhole from the casing using the reamer.

14. The method of claim 13, further comprising enlarging the borehole downhole from the casing, using the reamer, to a diameter that is greater than the diameter of the hole opener.

15. The method of claim 13, further comprising enlarging the borehole downhole from the casing, using the reamer, by approximately 50 percent of the drilling diameter of the drill bit.

16. The method of claim 12, wherein actuating the adjustable diameter reamer occurs in response to a differential pressure.

17. The method of claim 12, further comprising operating at least one bottom hole assembly element positioned between the drill bit and the reamer.

18. The method of claim 12, further comprising operating at least one bottom hole assembly element positioned between the reamer and the hole opener.

19. The method of claim 12, further comprising stabilizing one or more drilling assembly elements located in the borehole using a stabilizer positioned uphole from the hole opener.

* * * * *